US005080091A

United States Patent [19]

Peterson et al.

[11] Patent Number: 5,080,091

[45] Date of Patent: * Jan. 14, 1992

[54] AIR BUBBLING MATS FOR THERAPEUTICALLY AGITATING BATH WATER

[75] Inventors: Samuel F. Peterson, Chicago; Ronald O. Hilger, Elmhurst; William Kalnins, Maple Park, all of Ill.

[73] Assignee: Associated Mills Inc., Chicago, Ill.

[ * ] Notice: The portion of the term of this patent subsequent to Jan. 15, 2008 has been disclaimed.

[21] Appl. No.: 417,660

[22] Filed: Oct. 5, 1989

Related U.S. Application Data

[63] Continuation-in-part of Ser. No. 149,110, Jan. 26, 1988, Pat. No. 4,984,583, which is a continuation-in-part of Ser. No. 67,490, Jun. 26, 1987, abandoned.

[51] Int. Cl.[5] ..... A61H 9/00

[52] U.S. Cl. ..... 128/66; 4/542

[58] Field of Search ..... 128/64, 65, 66, 44; 5/455, 457, 458; 403/329; 4/542, 543, 544, 535; 137/846

[56] References Cited

U.S. PATENT DOCUMENTS

| | | | |
|---|---|---|---|
| 1,699,198 | 1/1929 | Millmather | 128/66 |
| 2,292,373 | 8/1942 | Groeriger | 137/846 |
| 3,274,624 | 9/1966 | Noerdinger | 5/455 |
| 3,628,812 | 12/1971 | Larralde et al. | 403/329 |
| 3,710,786 | 1/1973 | Rico et al. | 128/66 |
| 3,809,073 | 5/1974 | Baumann | 128/66 |
| 4,037,591 | 7/1977 | Sarno | 128/65 |
| 4,040,415 | 8/1977 | Kulisch | 128/66 |
| 4,325,149 | 4/1982 | Moreland | 4/488 |
| 4,358,359 | 10/1982 | Milbauer | 128/66 |
| 4,417,568 | 11/1983 | Nozawa et al. | 128/66 |
| 4,430,762 | 2/1989 | Marshall | 128/66 |
| 4,466,377 | 8/1984 | Kolb et al. | 403/329 |
| 4,468,822 | 9/1989 | McKay | 128/66 |
| 4,697,290 | 10/1987 | Alklind et al. | 5/455 |

FOREIGN PATENT DOCUMENTS

| | | | |
|---|---|---|---|
| 3089153 | 8/1962 | United Kingdom | 5/457 |

*Primary Examiner*—Richard J. Apley
*Assistant Examiner*—L. Thomas
*Attorney, Agent, or Firm*—Laff, Whitesel, Conte & Saret

[57] ABSTRACT

An air bubbling mat, which may be placed in the bottom a bath tub, provides a turbulence within the water. The mat includes three hinged or plugged in, and hollow blow molded sections with depressions on one side to form air passage ways through the hollow bath mat. In one embodiment, short sections of convoluted hose interconnect the three sections at the hinge. In another embodiment, plug-in connectors provide communication for pressurized air between said sections. This embodiment may also include a latch means to secure the mats together. An input port is centrally formed on at least one edge of the center section to give a better distribution of air within the air passage ways and to drain the mat. On the opposite side, a centrally located port may be provided in most embodiments to make a connection for attachments.

19 Claims, 7 Drawing Sheets

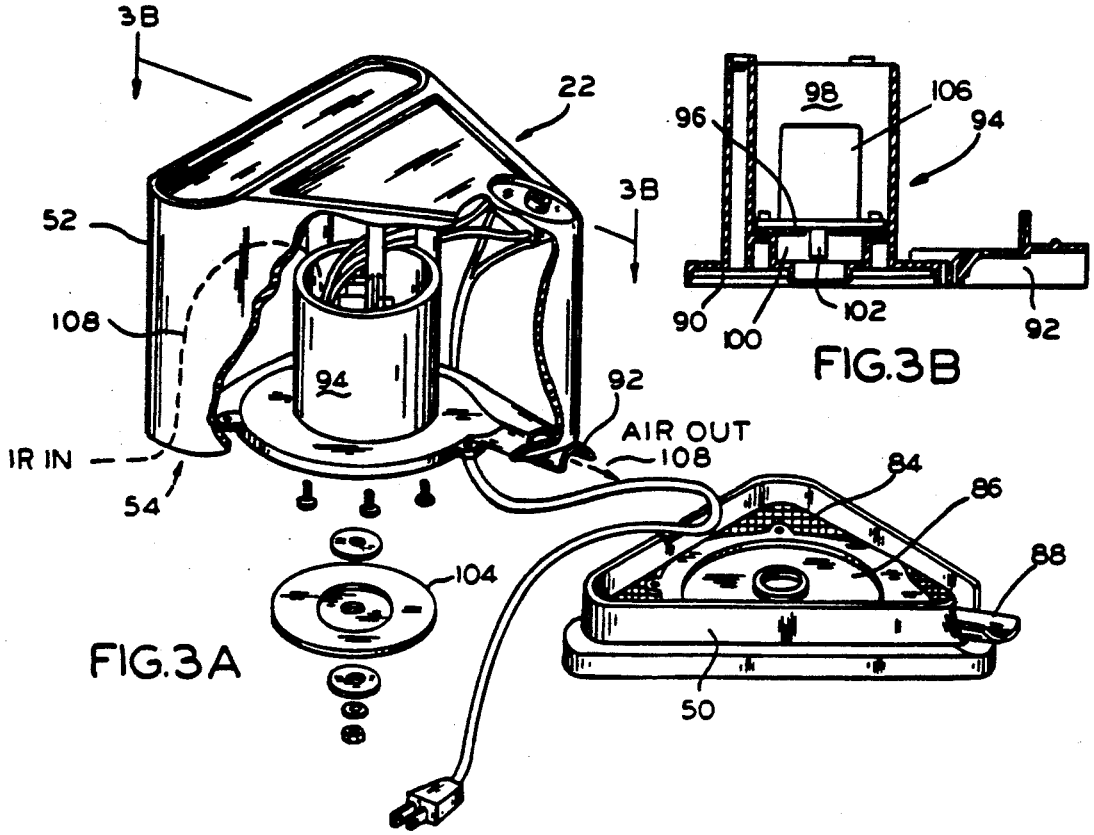
FIG.3A
FIG.3B
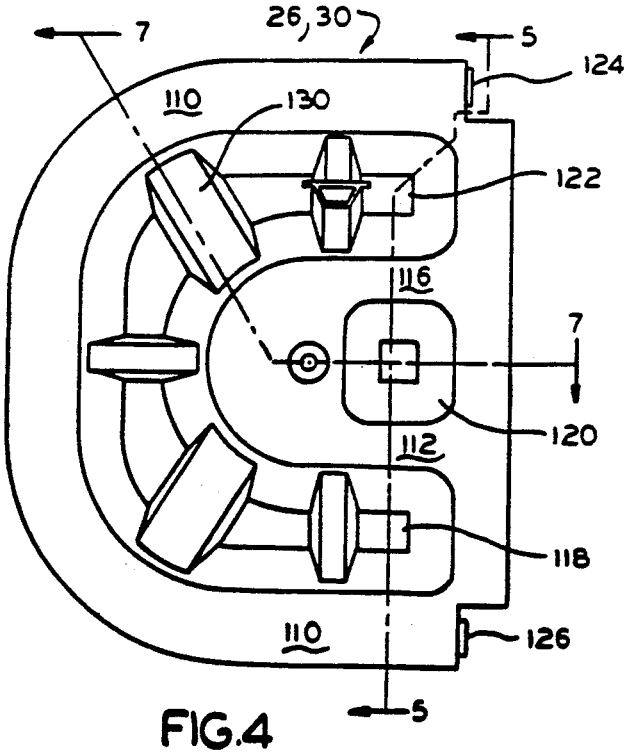
FIG.4
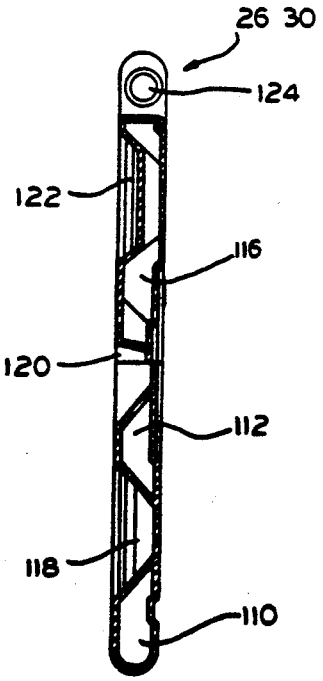
FIG.5

AIR BUBBLING MATS FOR THERAPEUTICALLY AGITATING BATH WATER

This is a continuation-in-part of S.N. 07/149,110 filed Jan. 26, 1988 which, in turn was a continuation-in-part of 07/067,490, filed June 26, 1987. Both parent applications are assigned to the assignee of this application.

This invention relates to air bubbling baths and more particularly to mats for therapeutically distributing and agitating air throughout a bath.

One example of air bubbling mats of the described type is found in U.S. Pat. No. 4,417,568. Other U.S. Pat. Nos. showing the state of the art are 4,290,982; 4,269,797; 4,122,846; 4,040,415; 4,008,498; 3,809,073; 3,111,686; 1,775,942; 1,699,198; and 1,350,974. A German patent 827,391 also shows the state of the art.

These and similar devices have presented a number of drawbacks which the invention has overcome. A first problem relates to the safety of the device. The air bubbling mat is used under water and is associated with an electrical air pump for pressurizing air to create the bubbles. As with all appliances used around water, there is a problem of shock and possibly of electrocution. The problem is made worse since the user may fail to follow instruction. For example, if he picks up the pad while it is full of water, it may run back through an air hose, into an electrical motor, and make contact with some hot wires. If the user or someone else walks into or trips over an air hose or an electrical cord, he may pull the air pump so that it could fall into the water or tip over to energize a puddle on the floor.

Another problem relates to the utility of check valves that might be used to prevent a back flow of water through the air hose and into the air pumping device. Those check valves have tended to be expensive, precision devices, which may stick, become limed, or otherwise fail, especially after long years of use. Also the fit or form of such a check valve is such that it may not operate reliably if there has been a physical abuse of the device, such as might occur if a user does not exercise due care.

Still another problem relates to draining the mat after its use. If the mat must be hung up to drain, it may require a structural change on a bathroom wall such as an installation of a hook. Alternatively, if the mat is hung from an existing structure such as a shower head or a shower curtain rod, there may not be enough physical strength to hold the mat if it is full of water. Or, if the mat is hung from a structure which is not centered over the tub, the mat may not drain in the tub, but may drain onto the floor.

Yet another problem relates to the method of folding the mat. Usually, it is as large as the bottom of the bath tub, which is too large for easy manipulation and storage. Therefore, it is a common practice to make the mat from a number of sections which fold over each other, which requires a hinge and some means for reliably conveying pressurized air between the sections of the mat. This requires a hinge mechanism which can maintain air pressure within the mat.

In order to manufacture such a hinged folding mat, it is necessary to provide a substantial number of man-hours to assemble hinges, air conveying tubes, and similar parts. Also, the hinged member and associated air conveying tubes, are almost certain to occupy some room and, therefore, to add bulk to the mat. Moreover, a folded mat is potentially more bulky to store than it has to be. Finally, the hinge mechanism could be a potential point of failure where pivot points may break or air conveying tubes may kink or crimp. Therefore, there is a need for a bubbling mat which may be "folded" without actually requiring either a hinge or air conveying tubes. Still another problem is to keep a suitably pressurized air chest that distributes air fairly uniformly over an entire bath tub sized mat.

Most of the prior art air bubbling mats have introduced air into one end of the mat which tends to have a greater pressure of air in that one end than in the other end. Also, the hose used to introduce air on one end of the mat makes it difficult to emplace and to use the mat. Either the air hose extends up the end of the tub where a user would like to lean his back or up the other end where there are faucet handles, water spouts or the like which should not be encumbered by the air hose.

Another problem is that very often, it is desirable to use the air bubbling mat in connection with some other appliance. Thus, for example, it may be desirable to add a foot rest, a back rest, or a hand held wand which would also bubble air into the bath water. Then, it is difficult to supply pressurized air to such appliance from the air hose at the end of the mat.

When pressurized air is supplied from an electric air pump to a bath mat submerged in water occupied by a human, it is necessary to provide for all of the foregoing considerations, such as safety from back drainage, electrocution, comfort convenience, and the like. It tends to become very expensive to provide all of these features for the mat, and the appliances, and yet such a device cannot become too expensive and still remain competitive.

Accordingly, an object of the invention is to provide new and improved air bubbling bath mats. Here, an object is to provide bath mats having safety devices built into them, such as new and novel check valves to prevent a back flow of water, and air pumps which are less likely to tip over or fall into a tub.

Another object of the invention is to provide better and more uniform distribution of air throughout an air bubbling mat.

Another object is to provide a mat with detachable panels having plug together connectors to provide a "fold-up" convenience while reducing storage bulk and preventing damage at a pivot point or air conveying tube breakage and crimping. Yet another object is to provide an embodiment of the mat with detachable panels which are latched together to preclude accidental disassembly of the bath mat while it is in use.

A further object is to provide an air bubbling mat which may be drained without requiring special hooks or risking unwanted drainage into an improper area.

Still another object of the invention is to provide attachments for suitable appliances which may be used with the air bubbling mat.

In keeping with an aspect of this invention, these and other objects are accomplished by a rigid molded pad including a plurality of sections which are plug connected to each other and may also include a latch to further secure the connection in order to prevent it from becoming disassembled during use. The pressurized air is centrally fed into the mat at an edge of a center section, to maintain a better distribution of the air. A second port is centrally provided on the opposite edge of the mat to enable an attachment to receive pressurized air therefrom. The pressurized air hose may include a duck-bill check valve to prevent any back flow of water into the air pump. The air pump is designed to be less likely to tip over and possibly to fall into the bath.

A preferred embodiment of the invention is shown in the attached drawing, wherein:

FIG. 3A is an exploded view, in perspective, of the air pump;

FIG. 3B is a cross section taken along line 3B—3B of FIG. 3A showing a bulk head and spill way for isolating any back flow of water from the electric pump;

FIG. 4 is a plan view of the bottom of an end section of the air bubbling mat;

FIG. 5 is a cross section taken along line 5—5 of FIG. 4;

Figure 1:
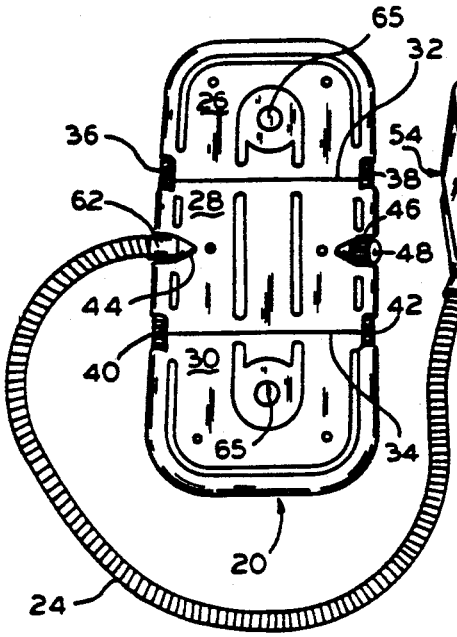
FIG. 1 is a pictorial view of the invention comprising an air bubbling bath mat, an air line hose, and an air pump.

In FIG. 1, an air mat 20 is connected to an air pump 22 via a convoluted air line hose 24. The air mat is made in three sections 26, 28, 30 in the hinged embodiment of FIGS. 1–12, from a preferably molded rigid plastic. The three sections 26, 28, 30 are hinged together in any suitable manner, as indicated by the lines 32, 34 in FIG. 1. For passage of pressurized air between the three sections 26, 28, 30 short sections of convoluted hose 36, 38, 40, 42 are connected across the hinged areas. The ribs of these convolutions provide a degree of rigidity which keeps the hose from collapsing. The valleys between the ribs provide a degree of flexibility which facilitate the folding of the mat.

Two ports 44, 46 are centrally formed on opposite edges of the center section 28. Either one of these ports (here 44 if FIG. 2B), may be used as an input port to connect the air line hose 24, which is also convoluted for strength and flexibility. Preferably, the hose is inserted into port 44 and then given a half turn. The opposite port 46 is normally closed with cap 48. If it is desirable to use an associated appliance or attachment in connection with the air bubbling mat, this cap 48 is removed and an output air line hose leading to the appliance is attached to the output port 46.

The air pump 22 (FIG. 1) is coupled to the distant end of the air line hose 24 at a relatively low point on the air pump housing. Thus, there is a much less chance of tipping or overturning the pump 22 if the hose 24 is pulled.

The base 50 of the housing is recessed slightly relative to the top 52 of the housing to provide elevated air intake ports 54. Therefore, if the air pump is resting on a deep pile rug, towel, or the like, it will not be sucked against the air intake port, as may happen when the air intake is in the bottom of base 50.

Figure 2A:
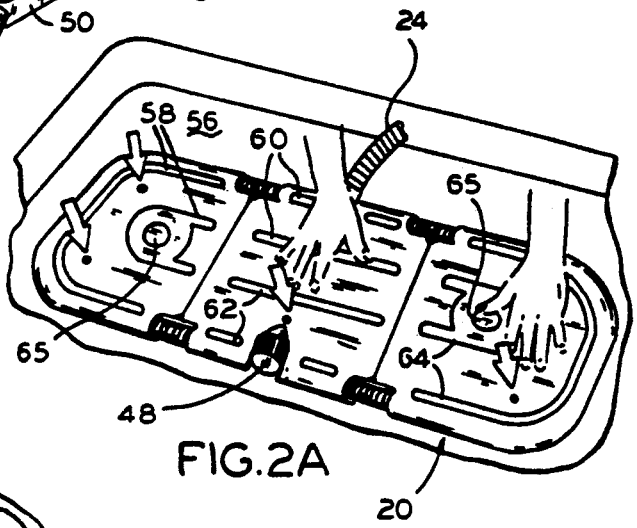
FIG. 2A is a perspective view of the inventive mat being installed in a bath tub.

An important advantage of the inventive air bubbling mat is seen in FIG. 2A. When the mat is placed in a bath tub 56, the air line hose 24 exits the tub via an easily reached central location. This is unlike most of the prior art air bubbling mat, where the air line hose is connected onto an end of the mat. That prior art end coupled air line hose either prevented the user from leaning back against the tub or interfered with an easy manipulation of faucet handles, water spouts or the like. Also, the areas enclosed by lines 58, 60, 62, 64 indicate patterns where air holes are provided from which air may bubble. In the end sections, the pattern is two concentric U-shaped patterns 58, and 64. The open ends of the U's point toward the center section. In the center section, the pattern is one of spaced parallel lines 60, 62 which complete two concentric somewhat oval patterns of air holes. Air holes may also be formed at 65, 65 to provide a sitz bath.

It should be apparent that, when air is introduced at a central location, such as 44, 46 (FIG. 1), the distance to the most remote air hole is half the distance that would be if the air is introduced at an end of the air bubbling mat 20. Thus, with the central connection, there is a better distribution of the pressurized air. Even if a person sits on the mat, shifts his weight, moves around, etc, the better distribution of air given by the center entrance will tend to keep a more uniform flow of air.

To preclude a back flow of water, a duck-bill check valve 66 (FIG. 2C) may be placed within the air line hose 24, preferably at an end fitting 62 which is connected to pump housing 50, as seen in FIG. 1. This check valve 66 (FIGS. 2D, 2E) is made of a soft elastomer, such as natural rubber (about 35–40 durometer). In greater detail, a generally cylindrical tubular section 67 rises from an outwardly projecting flange 63, which serves as an anchor point. The top of the cylindrical section 67 has a bevelled roof 68, 68 leading to a slit 69 extending across the top and along the apex of the bevel 68, 68 and continuing for a distance 70 which is more than 50% of the cylinder length down each side of the cylinder. The flange 63 fits into the end fitting 62 (FIG. 2C) and rests against a step 71 molded therein. A retainer ring 72 snaps into the end fitting 62 to hold the flange and, therefore, the duck-bill check valve in place.

Figure 2B:
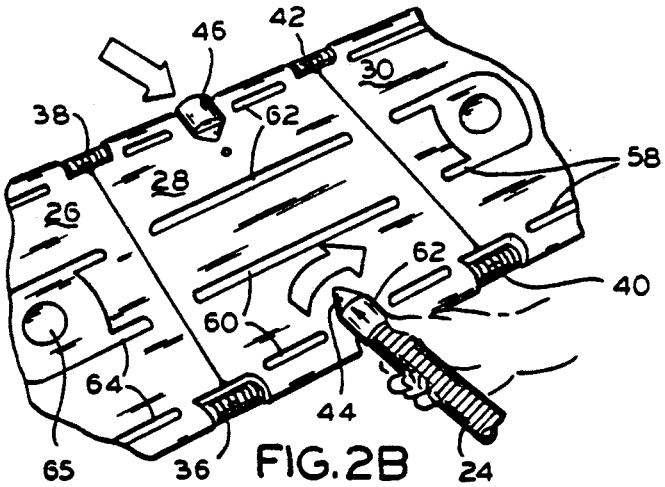
FIG. 2B is a fragmentary perspective view showing the air line hose being centrally installed on to an edge of the air bubbling mat, the convoluted or ribbed hoses at the hinge points, and the output or air take off port for pressurizing associated appliances.
Figure 2C:
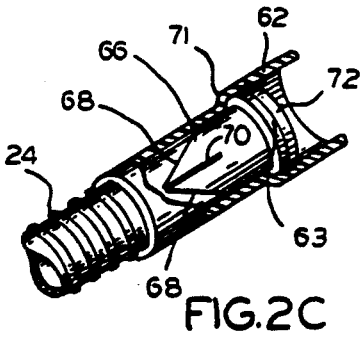
FIG. 2C is a fragmentary view of the air hose showing the location of a duck-bill check valve.
Figure 2E:
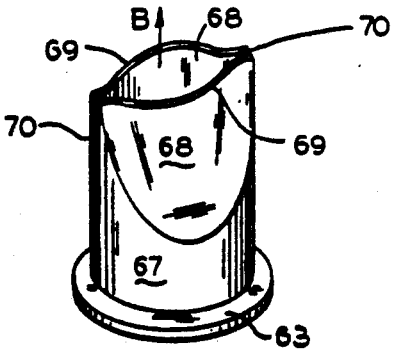
FIG. 2E is a similar perspective view of the duck-bill check valve in an open position.
Figure 2D:
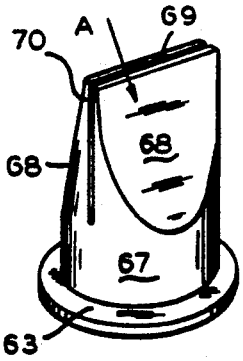
FIG. 2D is a perspective view of the duck-bill check valve in a closed position.
Figure 6:
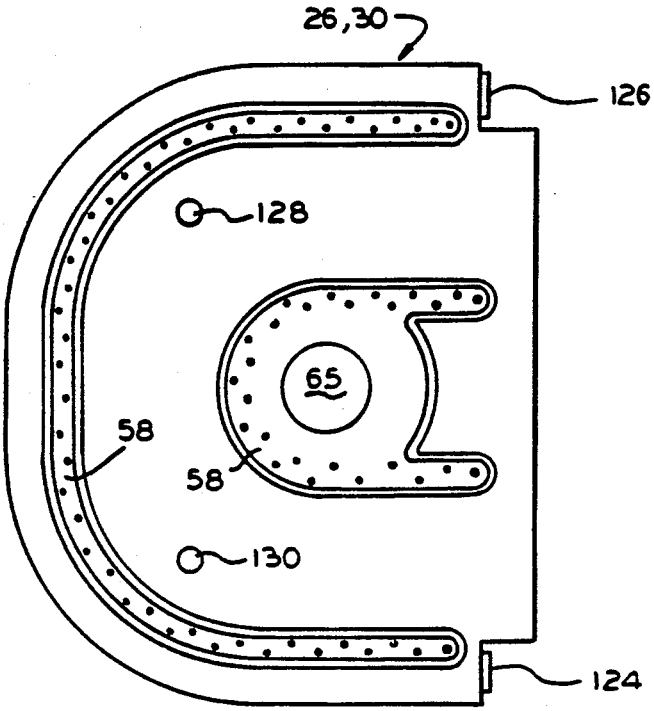
FIG. 6 is a top plan view of the air mat of FIG. 4.

The operation of the duck-bill check valve is best seen in FIGS. 2D, 2E. More particularly, if any water flows back through the air line hose 24, it impinges upon the bevelled roof surfaces 68, 68, as indicated by the arrow A. The resulting pressure forces the slits 69, 70 into a closed position. Therefore, little, if any, water can pass through the slit. On the other hand, air can pass freely through the slit in the direction B (FIG. 2E) responsive solely to the air pressure within the hose. Thus, there is only a one-way flow of fluid (air or water) through the air line hose 24.

The air pump construction is best seen in FIGS. 3A, 3B, as having two principal parts, base 50, housing 52. The bottom panel of base 50 has an open grille work 84 through which any water which back flows through the duck-bill check valve may pass. Of course, there should be no such water; therefore, this is a safety feature which may or may not be provided. The space within the base 50, which is beneath the grille work 84 is filled with a sound deadening, but completely porous, sponge-like material. A circular depression 86 provides one half of an impeller housing leading to the air discharge port 88 to which the air line hose 24 connects. The opposite and complementary sides of the impeller housing 90 (FIG. 3B) and air discharge port 92 are in a lower plate of motor support housing 94.

The motor support housing 94 includes a bulk head 96 which separates a motor containing section 98 from a water collection compartment 100. Thus, in the very unlikely event that water passes through the duck-bill check valve 66, it reaches the water collection compartment 100 and does not rise into the motor section 98. A spill way 102 is positioned in the wall of housing 94 to empty the water in compartment 100. The volume of compartment 100 and the area of spill way 102 are large enough to contain and remove all water before it can rise into the motor section 98 under even the worst case where the entire air line hose 24 and air bubbling mat 20 is full of water and duck-bill check valve 66 fails completely or is inadvertently omitted or removed. The water passing through spill way 102 leaks out through grille 84 (FIG. 3A).

The motor 106 rotates impeller 104 to drive air through intake opening 54, air passage 108 and out the port 88–92 to air line hose 24 (FIG. 1) and on to the air bubbling mat 20. The motor may be given three speeds by providing two windings and a diode which may be switched into the energizing circuit to eliminate half cycles of one polarity. The path 108 for the air stream passes through motor support housing 94, the impeller housing 86, 88, 90 and output passage 88, 92. This air stream cools the motor and is warmed by any heat generated within the motor.

Figure 7:
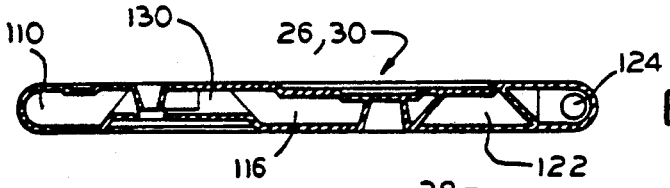
FIG. 7 is a cross-section taken along line 7—7 of FIG. 4.
Figure 8:
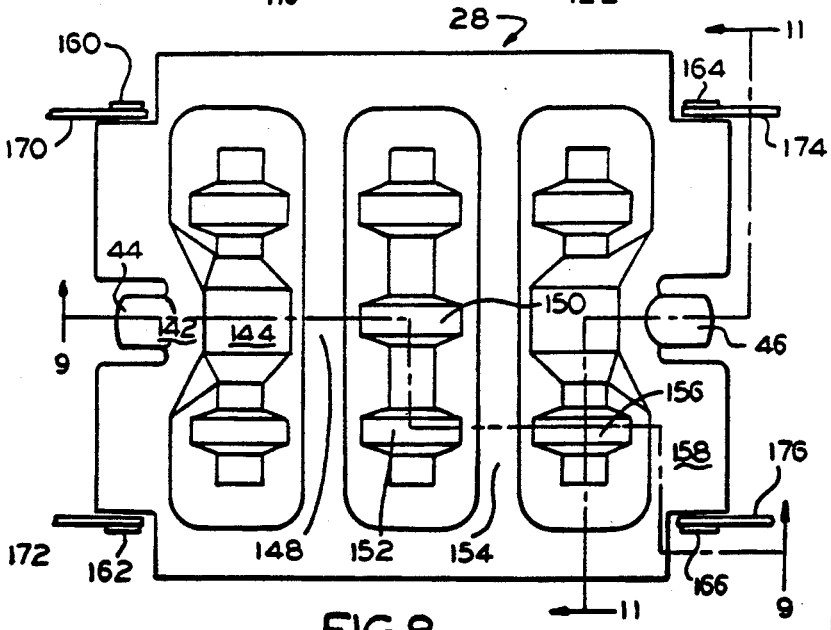
FIG. 8 is a plan view of the bottom of a center section of the air bubbling mat.
Figure 11:
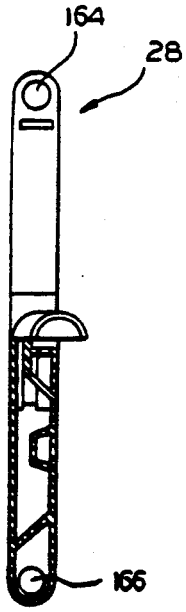
FIG. 11 is a cross section taken along line 11—11 of FIG. 8.
Figure 9:
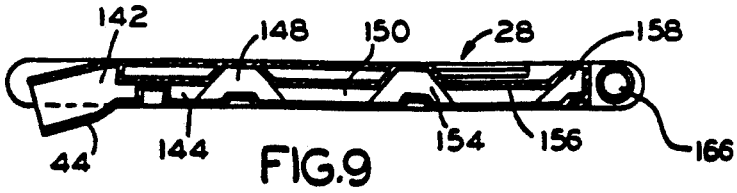
FIG. 9 is a cross section taken along line 9—9 of FIG. 8.
Figure 10:
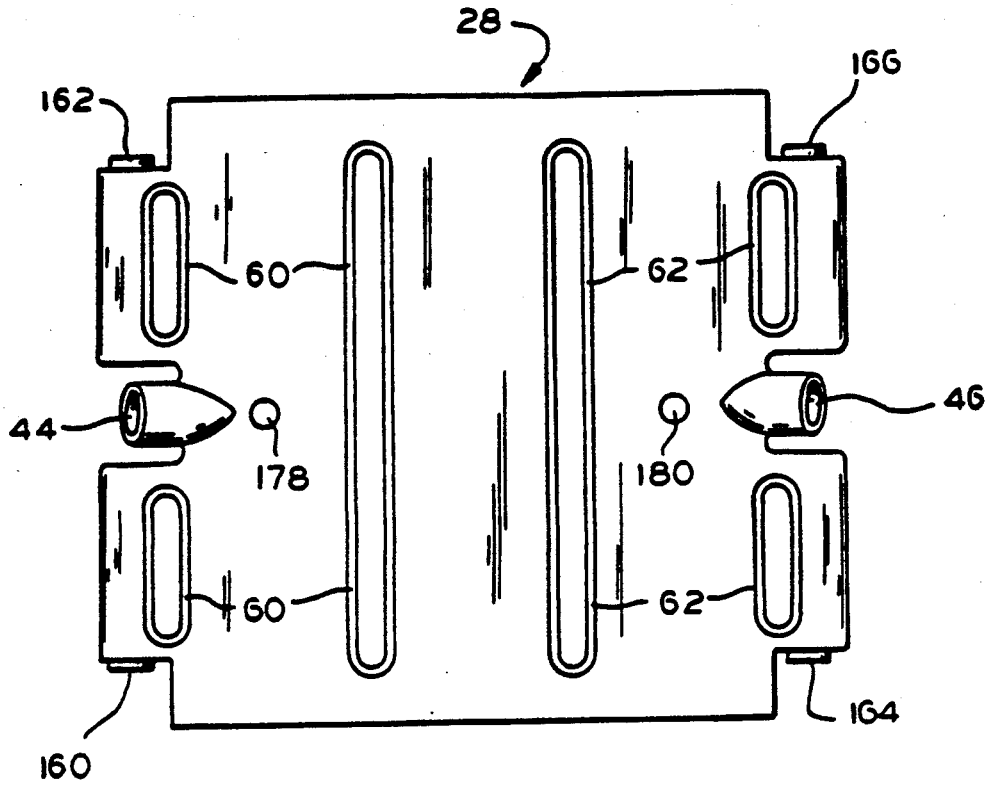
FIG. 10 is a top plan view showing the center section of the air bubbling mat.

The construction of the air bubbling mat 20 is seen in FIGS. 4–11, of which FIGS. 4–7 show each of the end sections 26, 30 and FIGS. 8–10 show the center section 28.

The end section (FIGS. 4–7) is preferably a blow molded part having a bottom surface (FIG. 4) with depressions and elevations forming a plurality of communicating air passages best seen in cross section in FIGS. 5, 7 where air passage way 110, 112, 114, 116, 130, for example, are separated by depressed areas 118, 120, 122. The air passages terminate at their opposite ends in ports 124, 126. Bolt holes are formed at 128, 130 to receive anchor bolts for suction cups (not shown) on the bottom of the air bubbling mat 20 to secure it to the bottom of a bath tub, while it is in use.

The top side of the mat has air holes formed in the pattern of two concentric generally U-shaped rows 58 58 of air holes for discharging air into the water within a bath tub. These air holes are directly over the air passage ways formed by the depressions on the bottom of the mat 20. If a sitz bath is desired air holes may be formed in area 65.

The center section 28 of the air bubbling mat 20 is see in FIGS. 8–11. Again, there is a bottom surface (FIG. 8) which has a plurality of depressions forming a plurality of communicating air passageways, 142, 144, 148, 150, 152, 154, 156, 158. The input and output ports 44, 46 provide connections between the air passage, the air line hose 24 and a similar hose (not shown), if any, leading to appliances. The air passage way terminates at air ports 160, 162, 164, 166, where they confront air ports 124, 126 (FIG. 4) on the end sections 26, 30.

The convoluted hoses 36, 38, 40, 42 (FIGS. 1,2) join these ports 124, 126, 160–166 to provide for air pressure communication throughout the air bubbling mat 20. Hinge plates 170, 172, 174, 176 (FIG. 8) mechanically and pivotally join the center section 28 to the end sections 26, 30.

The top side (FIG. 10) of the air bubbling mat center section 28 has four spaced parallel rows 60, 62 of air holes through which air may bubble into the bath water. These rows 60, 62 confront the open ends of the concentric U-shaped rows 58 (FIG. 6) of air holes in the end sections 26, 30 in order to form two long oval patterns of air holes over the entire surface of mat 20. Holes 178, 180 provide anchor points for suction cups to hold the mat in place on the bottom of the tub.

Figure 12:
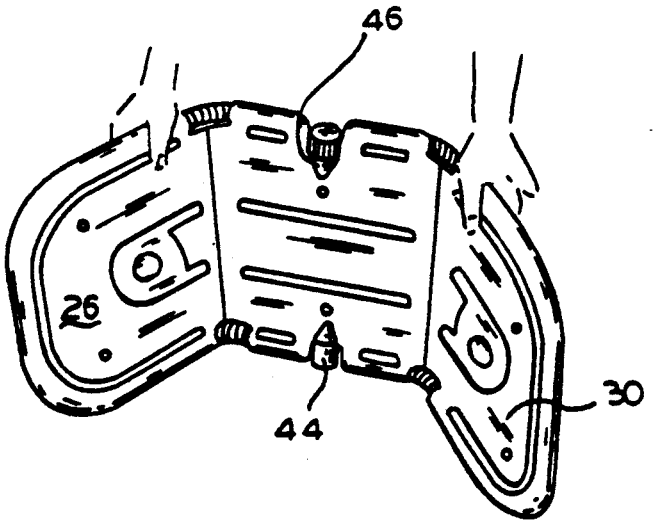
FIG. 12 shows, in perspective, how the air mat is set on its edge when it is drained.

FIG. 12 illustrates how all water may be drained from the air bubbling mat 20. Either the cap 48 (FIG. 2B) or the air hose 24 is removed from the mat 20 which is then stood on its edge, with the end sections 26, 30 folded slightly to give it vertical support. With the central location of the ports 44, 46, it is easy for all water to drain from the mat while it is completely and reliably surrounded by the bath tub. There is no danger that the mat may drain onto the floor even if the user is grossly careless in how he sets up the mat for the drainage, or if it falls over.

Heretofore, the port supplying pressurized air has usually been on one end of the air mat. Therefore, to drain, it was necessary to hang it from a hook on the opposite end. Thus, if the user was careless in holding or hanging the mat, the water might spill out onto the user, the floor, or some other unwanted place.

Figure 13:
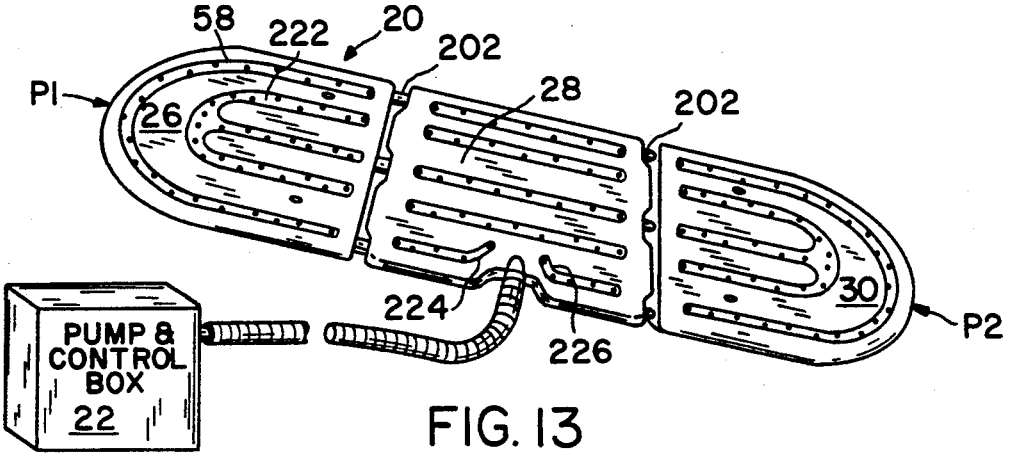
FIG. 13 is a pictorial view of a second embodiment of the invention comprising a plug together air bubbling bath mat, an air line hose, and an air pump.
Figure 14:
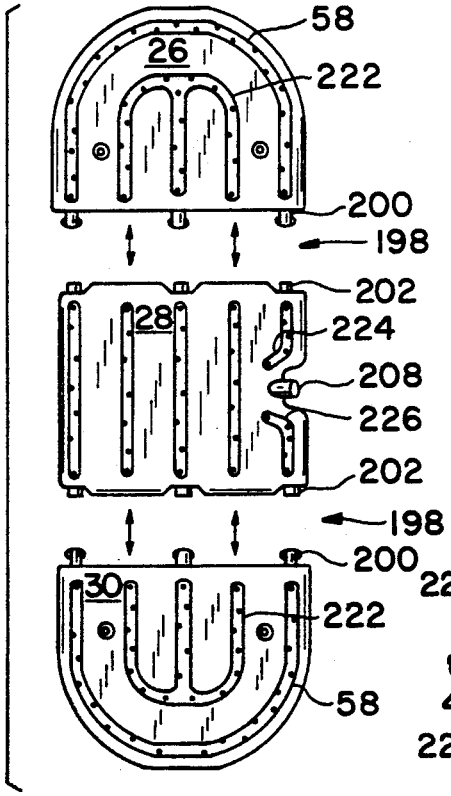
FIG. 14 is an exploded view showing the inventive mat with detached plug-in connectors between the three sections.
Figure 20:
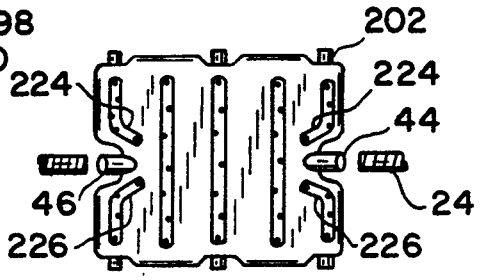
FIG. 20 is a fragmentary view of another embodiment showing the inventive mat with separate input and output ports.

In another and plug-in embodiment (FIGS. 13–20), the same mat sections 26, 28, 30 may be plugged into each other (as indicated by the arrows 198) at plug 200 and socket 202 FIGS. 14 and 20, for example. Each plug (FIG. 16) consists of a hollow cylindrical piece 200 adapted to be telescopingly received within a smaller hollow cylindrical socket portion 202. The entrance to cylindrical socket portion 202 may be chamfered or slightly tapered inwardly at 204 (FIG.20) to facilitate an insertion of plug 200. The plug section 200 has an enlarged portion 206 to ensure a tight fit and locking into cylindrical piece 200. Yet enlarged portion 206 is not so large that it can not be pulled out of socket 202.

Center mat section 28 has each of six of the cylindrical socket pieces 202 (FIG. 14), three of which are located on each of the opposite edges which confront the end sections 26, 30. Each of the end mat sections 26 and 30 include three cylindrical plug portions 200 (FIG. 14) located on the inner edges which confront the cylindrical socket pieces 202 located on the edges of center section 28.

The plugs 200 and sockets 202 are easily connected by aligning them and applying a slight pressure P1, P2 on the outer ends of the mat, thus causing the center section 28 to plug into end sections 26, 20.

Figure 21:
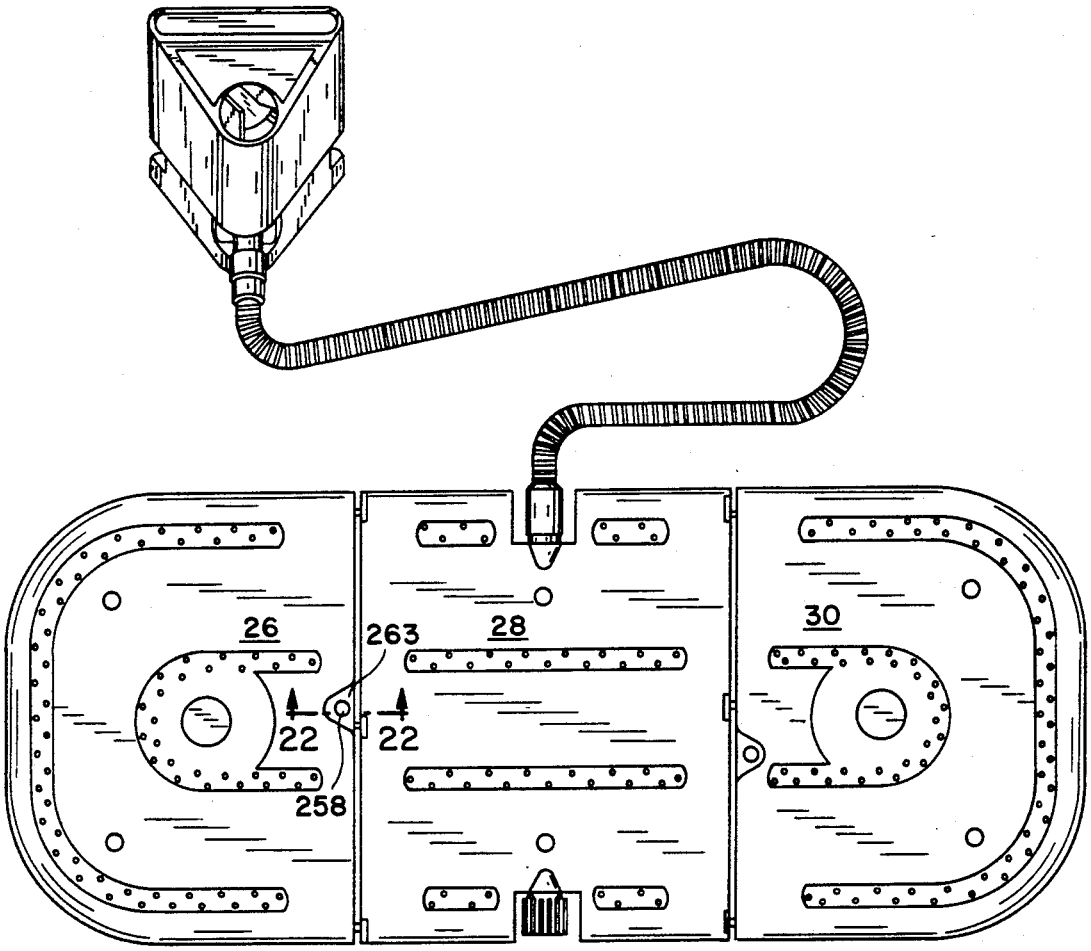
FIG. 21 is an top plan view of a third embodiment of the invention wherein the pad sections of FIGS. 14–20 are latched together to form an air bubbling bath mat.
Figure 22:
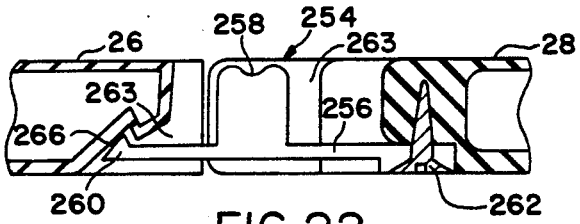
FIG. 22 is a cross section taken along line 22—22 of FIG. 21.

FIGS. 21, 22 reveal a plug-in embodiment which is basically the same as the embodiment of FIGS. 13–20, plus a latch means so that mat sections 26, 28, 30 may be latched together. The sections may be plugged together by using plugs 200 and sockets 202 (FIG. 16) which are telescopingly joined to provide communication for air flow, and mechanical interconnection of the mat sections. As seen best in FIG. 22, latch means 254 has a flexible leaf spring or tongue 256 which includes an integral pushbutton 258 and latch 260. The flexible leaf spring is anchored at one end by fasteners 262 to an end of mat section 26 or 30. The flexible leaf spring may be constructed of a plastic material with a suitable memory to provide spring qualities. The spring is mounted within a generally rectangular opening 263. When the sections are latched together, the leaf spring extends across the sections 26–28 or 28–30 on the bottom side of the bath mat. Opening 263 includes a recess 266 which forms a keeper that receives and engages latch 260. In addition, opening 263 includes an aperture 264 on end section 26 or 30 which receives pushbutton 258. Latch 260 interengages with keeper 266 to lock the sections together.

To connect the end sections 26 or 30 with center section 28, the respective plugs 200 and sockets 202 are aligned with a slight pressure applied to the ends of the sections, thus causing the plugs to engage the sockets and causing the latch 260 to engage keeper 266. Both latch 260 and an edge 270 have mutually slanted surfaces which provide a camming effect to facilitate the downward flexing of leaf spring 256 and a subsequent engagement of the latch and keeper.

Figure 15:
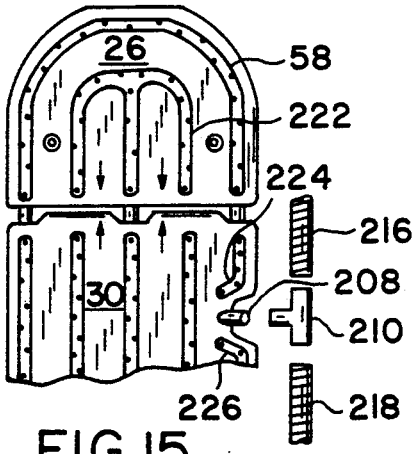
FIG. 15 is a fragmentary view of one embodiment showing the inventive mat with plug-in detachable connectors and one input/output port.
Figure 17:
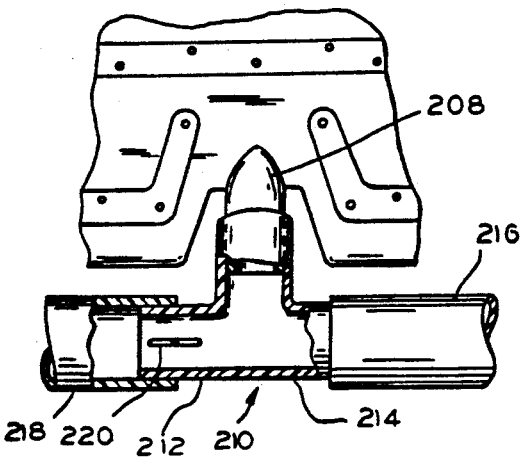
FIG. 17 is a fragmentary perspective view of the output or air take off port and butterfly valve.
Figure 16:
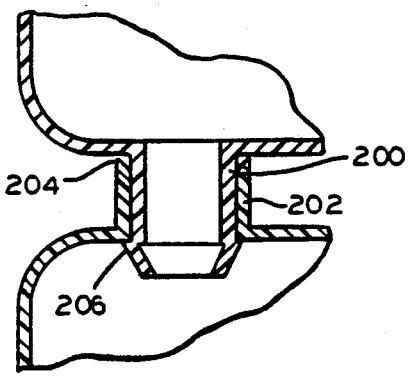
FIG. 16 is a cross section showing a plug-in connector between the mat sections.
Figure 18:
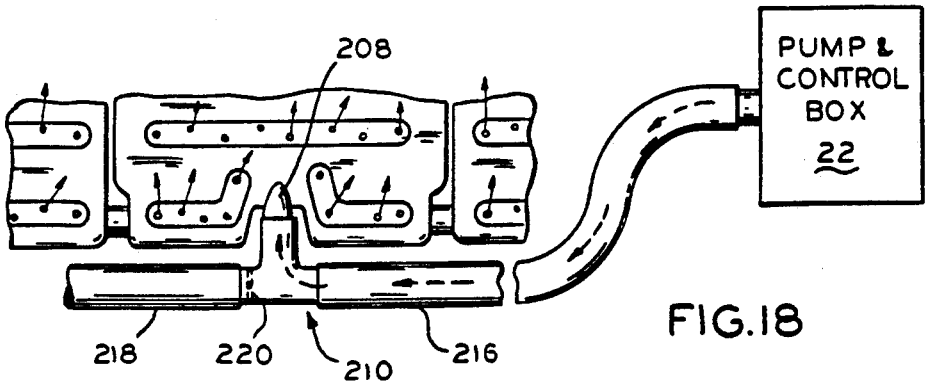
FIG. 18 is a fragmentary top plan view of the pressurized air hose and a closed butterfly valve showing air flow exclusively into the mat.

In one embodiment, one input/output port 208 is centrally formed on an edge ad at the center of section 28, as depicted in FIGS. 13, 14, and 15. For this embodiment, an inverted T-shaped section 210 is plugged into an end of the port 208. As shown in FIG. 17, the open ends 212, 214 of T-section 210 are adapted to receive air line hoses 216 and 218. Air line hose 216 is coupled at its distant end to air pump 22. Air line hose 218 is attached at its distant end to any suitable appliance which is then being used with the air bubbling mat.

Figure 19:
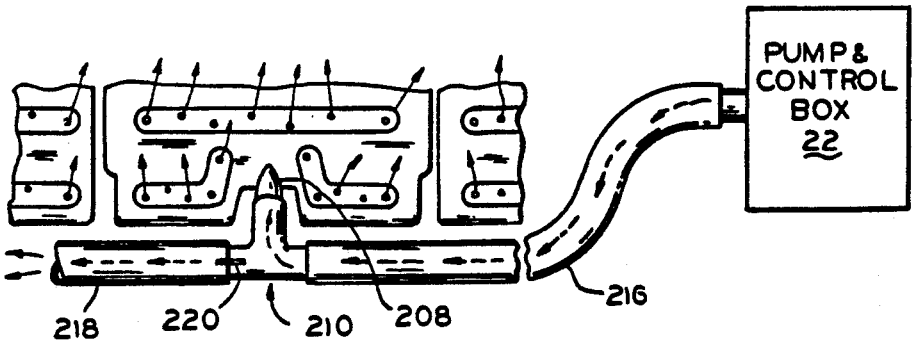
FIG. 19 is a fragmentary top plan view of the pressurized air hose and an open butterfly valve showing air flow both bypassing and into the mat.

The inverted T-shaped section 210 contains a butterfly valve 220 that selectively causes the pressurized air to be directed either into the air bubbling mat (FIG. 18) or to both the mat and the attached appliance (FIG. 19). The butterfly valve 220 is located off center and toward the end 212 of the inverted T-shaped section 210. In operation, the butterfly valve 220 directs the flow of pressurized air into the mat (FIG. 18) by internally blocking the air flow into the appliance air line hose 218. Similarly, when positioned horizontally (FIG. 19), the butterfly valve 220 causes the pressurized air to enter hot only port 208 and the mat, but also through port and the appliance hose 218. The butterfly valve 220 is only necessary in the embodiment of the invention with one port (e.g. FIG. 15).

The embodiment of FIG. 20 is a plug-in embodiment which is similar to the embodiments of FIGS. 13 and 20–21, with the two ports 44, 46 of FIG. 2B, either one of which may be an input or an output port.

In the embodiments of FIG. 13–22, the top side of the mat has air holes formed in the pattern of one generally U-shaped row 58 (FIG. 14) and a somewhat "W" shaped design 222 situated in the interior of the U-shaped row 58. The rows of air holes near the inlet and outlet ports 208, 44, 46, angle inwardly, as shown at 224, 226, in order to provide the same number of air holes that would be present if the ports were not there.

Those who are skilled in the art will readily perceive how to modify the invention. Therefore, the appended claims are to be construed to cover all equivalent structures which fall within the true scope and spirit of the invention.

We claim:

1. A disassembled air bubbling bath arrangement comprising an air pump, an elongated air mat made of a plurality of separate sections which may be joined together and taken apart, an air line hose extending from said air pump to a central point of a centrally located one of said sections, said central point being on an edge at the side of said air mat, each of said sections having at least one input/output port for enabling a passage of air into or out of said section, said air mat sections separating for storage or joining together by being plug-in connected to each other at said input/output ports in order to form said air mat of joined sections, said plug-in connection being in the form of at least one tube on each section which removably telescopes with a tube on another section to form a conduit means extending from one section straight into the other of said sections to provide air passageways at locations where the sections are plugged together in order to provide a communication of air between said sections, said bath mat being a rigid non-folding structure after it is assembled with said plug-in connections in place, and a plurality of air holes on corresponding surfaces of said sections for enabling air to escape from said sections to aerate water in a bath tub.

2. The arrangement of claim 1 wherein said air pump has a portable housing with a point for connecting said air line hose thereto, said point for connecting said air line hose being at a lower region of said housing in order to greatly reduce the likelihood of said air pump tipping over if said air line hose is pulled, and said housing having a corner at the point where said air line hose is coupled whereby a pull upon said hose acts upon a corner which is not likely to become as a fulcrum about which the housing might tip forward.

3. The arrangement of claim 1 wherein said air mat comprises at lest three sections with air passageways formed therein by said telescoping of said plug together tubes in order to form an assembled bath mat having two opposite ends and center sections.

4. The arrangement of claim 3 and an output air coupling near the center of said mat for connecting an attachment to be energized by air supplied from said air pump through said air line hose to said mat, said output air coupling being on a side of said bath mat which is opposite said central point.

5. The arrangement of claim 3 wherein each of said sections of said mats is a hollow rigid structure having depressions on one side for forming said air passageways through the hollow portion of said mat and with air holes in the opposite side for discharging air from said air passageways telescoping plug together tubes being positioned to interconnect said air passageways in adjacent sections.

6. The arrangement of claim 5 wherein said air holes are formed in concentric patterns of a U-shape on each of said end sections, said U-shape having open ends projecting toward said center section, and parallel lines on said center sections, said spaced parallel lines being generally aligned with the open ends of said U-shapes whereby the air hole pattern on all three sections is a plurality of concentric elongated generally oval patterns.

7. The arrangement of claim 6 and air holes formed near a center of said U-shapes to provide a sitz bath.

8. The arrangement of claim 7 and mechanical latch means extending from one section to another section in parallel with said telescoping tubes for locking together said mat sections when said telescoping plug together tubes are joined.

9. The arrangement of claim 1 and a duck bill check valve in said air lines hose, said check valve being positioned to enable air to pass in a forward direction from said pump through said air line hose to said mat but to block a passage of water from said mat to said pump, and a water compartment with a spill way located near the end of said hose to collect and discharge any water which may pass from said mat through said check valve toward said pump, said compartment and spill way being large enough to keep water from reaching electrical points in said air pump under worst case conditions wherein said check valve fails while said hose and mat are filled with water.

10. The arrangement of claim 1 wherein said air mat comprises at least two sections which are plug-in connected to each other in order to assemble said air mat, wherein said plugin connection is a tube which forms a conduit means extending between said sections to provide air passageways at locations where the sections are plugged together.

11. The arrangement of claim 10 wherein said conduit means comprises at least one hollow cylindrical piece on each of confronting sides of the two sections, said hollow cylindrical pieces telescoping together when said sections are plugged into each other.

12. The arrangement of claim 11 where an outer one of said telescoping cylindrical pieces is chamfered and the inner one of said telescoping pieces has an enlarged portion to insure a tight and locking fit.

13. An air mat comprising a center section having first tubular plug-in connector means distributed along two oppositely disposed edges thereof, two end sections, each of said sections having a hollow interior defining an air passage with second plug-in tubular connector means in said end sections having access to said passage and confronting said first plug-in connectors, whereby said sections are removably joined to each other to form a non-folding structure by plugging said connectors together and are separated by being unplugged from each other, said plug-in connectors providing communicating air passages between said sections, an upper side of each of said sections having a plurality of air holes formed therein to enable air to bubble from said mat, and flexible hose means coupled to a center input port on said center section for supplying compressed air to said air passageways.

14. The air mat of claim 13 wherein said center input port includes a valve means for selectively directing compressed air either into said mat or into associated appliances.

15. The air mat of claim 13 and latch means for securing the sections together.

16. The air mat of claim 15 wherein the latch means comprises a flexible leaf spring which is fastened at a first end to a first one of said sections and which is engageable at a second end with a keeper on a second one of said sections.

17. The air mat of claim 16 wherein the latch means further comprises a pushbutton which, when depressed, deflects the second end of the leaf spring to disengage the latch from the second mat.

18. The air mat of claim 17 wherein the first section includes an aperture for receiving the pushbutton so that the pushbutton can be depressed from the top of the first section.

19. A hollow generally flat bubbling air bath mat comprising at least a center section having first tubular plug-in connector means and latch means distributed along two oppositely disposed edges thereof, two independent generally flat end sections, each of said sections having a hollow interior defining at least one air passage therein, second plug-in tubular connector means along one edge of each of said end sections and having access to said air passage said second plug-in tubular connector means confronting said first plug-in tubular connector mean of said center section, each of said end sections also having a means which is engageable with said latch means to hold said sections in an assembled bubbling bath mat condition, whereby said sections are removably joined to each other to form a non-folding structure by plugging said connector means together and by engaging said latch means and are separated by unlatching said sections and pulling said plug-in connections apart, said plug-in connector means providing communicating air passages extending straight between said sections, at least an upper surface of each of said sections having a plurally of air holes formed therein to enable air to bubble from said mat, and flexible hose means coupled to a centrally located input port on said center section intermediate said two oppositely disposed edges for supplying compressed air to said air passageways.

* * * * *